US007075026B2

(12) United States Patent
Huang et al.

(10) Patent No.: US 7,075,026 B2
(45) Date of Patent: Jul. 11, 2006

(54) MOVABLE CONTACT BODY AND PANEL SWITCH USING THE SAME

(75) Inventors: Cheng-Pin Huang, Tu-chen (TW); Ssu-Min Lung, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/025,144

(22) Filed: Dec. 28, 2004

(65) Prior Publication Data

US 2005/0211537 A1 Sep. 29, 2005

(30) Foreign Application Priority Data

Mar. 26, 2004 (TW) ..... 9310821

(51) Int. Cl.
*H01H 1/10* (2006.01)

(52) U.S. Cl. ..... 200/516; 200/512

(58) Field of Classification Search ..... 200/5 A, 200/5 R, 310–314, 341–345, 512–517, 304, 200/305; 361/816, 818
See application file for complete search history.

(56) References Cited

U.S. PATENT DOCUMENTS 3,950,846 A * 4/1976 Johnson ..... 200/5 A
3,968,336 A * 7/1976 Johnson ..... 200/5 A
3,969,595 A * 7/1976 Johnson ..... 200/5 A
3,979,568 A * 9/1976 Johnson ..... 200/5 A
4,463,234 A * 7/1984 Bennewitz ..... 200/516
5,313,027 A * 5/1994 Inoue et al. ..... 200/5 A
5,513,078 A * 4/1996 Komrska et al. ..... 361/816
5,924,555 A 10/1997 Sadamori et al.
6,259,046 B1 6/2000 Iwama
6,417,467 B1 * 7/2002 Yamagata ..... 200/5 A
6,548,779 B1 * 4/2003 Takahashi et al. ..... 200/516
6,604,278 B1 * 8/2003 Sera et al. ..... 29/622
6,906,274 B1 * 6/2005 Ito et al. ..... 200/512
6,924,448 B1 * 8/2005 Sera et al. ..... 200/516
2002/0017449 A1 * 2/2002 Takahashi et al. ..... 200/516
2002/0112948 A1 * 8/2002 Sera et al. ..... 200/516

* cited by examiner

*Primary Examiner*—Michael Friedhofer
*Assistant Examiner*—Lisa Klaus
(74) *Attorney, Agent, or Firm*—Wei Te Chung

(57) ABSTRACT

A movable contact body includes a separator (13), a number of domes (12), an insulative film (11) and a shielding (10). The separator is made of insulative material and is substantially a planar sheet. The domes are made of resilient conductive material and are located on the separator in pre-determined locations. The insulative film coats on upper surfaces of the domes. The planar shielding is made of conductive material and coats on the insulative film. The planar shielding defines a number of openings (100) in predetermined locations corresponding to the domes. Each opening receives one dome therein.

9 Claims, 3 Drawing Sheets

MOVABLE CONTACT BODY AND PANEL SWITCH USING THE SAME

BACKGROUND OF THE INVENTION

1. Field of the Invention

The present invention relates to a movable contact body employed for an operating panel of various electronic equipment, and to a panel switch using the movable contact body.

2. Description of the Prior Art

A conventional movable contact body for a panel switch is described in U.S. Pat. No. 5,924,555. The movable contact body comprises a separator, a plurality of dome-like movable contacts disposed on the separator in predetermined locations, and a resilient film coating the upper surfaces of the dome-like movable contacts.

The separator is made of paper or other insulative film to prevent the corrosion of the dome-like movable contacts by the gases in air or the sticking of foreign matter thereto. The dome-like movable contacts are made of resilient and conductive material. The resilient film coats on the dome-like movable contacts, and employs an adhesive agent on its lower surface. The separator is bonded to the lower surface of the resilient film through the adhesive agent, thus closes openings of the movable contacts. A conductive film is printed on an upper surface of the resilient film.

When the movable contact body is used in the panel switch, the separator is removed. The movable contact body is deposed on a substrate sheet. The substrate sheet has a plurality of central fixed contacts and periphery fixed contacts correspondingly surrounding the central fixed contact. The dome-like movable contacts are disposed corresponding to the fixed contacts, of which an apex of the dome-like movable contact corresponds to one of the central fixed contact and a periphery portion of the dome-like movable contact corresponds to the periphery fixed contact.

Though the invention works well, there is some problem it can not solve. The movable contact body employs the separator, the plurality of movable contacts, the resilient film and the conductive film to achieve the object of the invention. As the conductive film is combined with the resilient film by an additional printing process, which may increases the cost and the step of processing.

Hence, an improved movable contact body is required to overcome the disadvantages of the prior art.

BRIEF SUMMARY OF THE INVENTION

A main object of the present invention is to provide a movable contact which can save material and may be easy processed.

A movable contact body according to the present invention comprises a separator, a plurality of domes, an insulative film and a shielding. The separator is made of insulative material, and is substantially a planar sheet. The plurality of domes is made of resilient and conductive material. The domes locate on the separator in determined locations. The insulative film upper surfacely coats on the domes. The planar shielding is made of conductive material, and coats on the insulative film. The planar shielding has a plurality of openings in predetermined locations corresponding to the domes, and each opening receives one dome therein.

The shielding is substantially a byproduct of the domes, of which the domes are punched from a planar metal sheet and the left material is used as the shielding then. The insulative film is adhesive to the separator and secures the domes therebetween. The separator surfacely coats on the domes and employs an adhesive agent on its lower surface.

To compare with the conventional invention, the merit of this invention is that the movable contact body has the shielding, which is the left material of the planar metal sheet after punching the domes. The shielding is employed to suppress the extraneous emission of electromagnetic waves and reduce the adverse effect of static electricity, and can achieve an even better effect as a conductive film used in the prior art. As the shielding is a substantially planar sheet, the processing of the movable contact body can be easier; and as the shielding is the left material of the planar metal sheet after punching the domes, this invention can save much material.

Other objects, advantages and novel features of the invention will become more apparent from the following detailed description of a preferred embodiment when taken in conjunction with the accompanying drawings.

DETAILED DESCRIPTION OF PREFERRED EMBODYMENT

Figure 1:
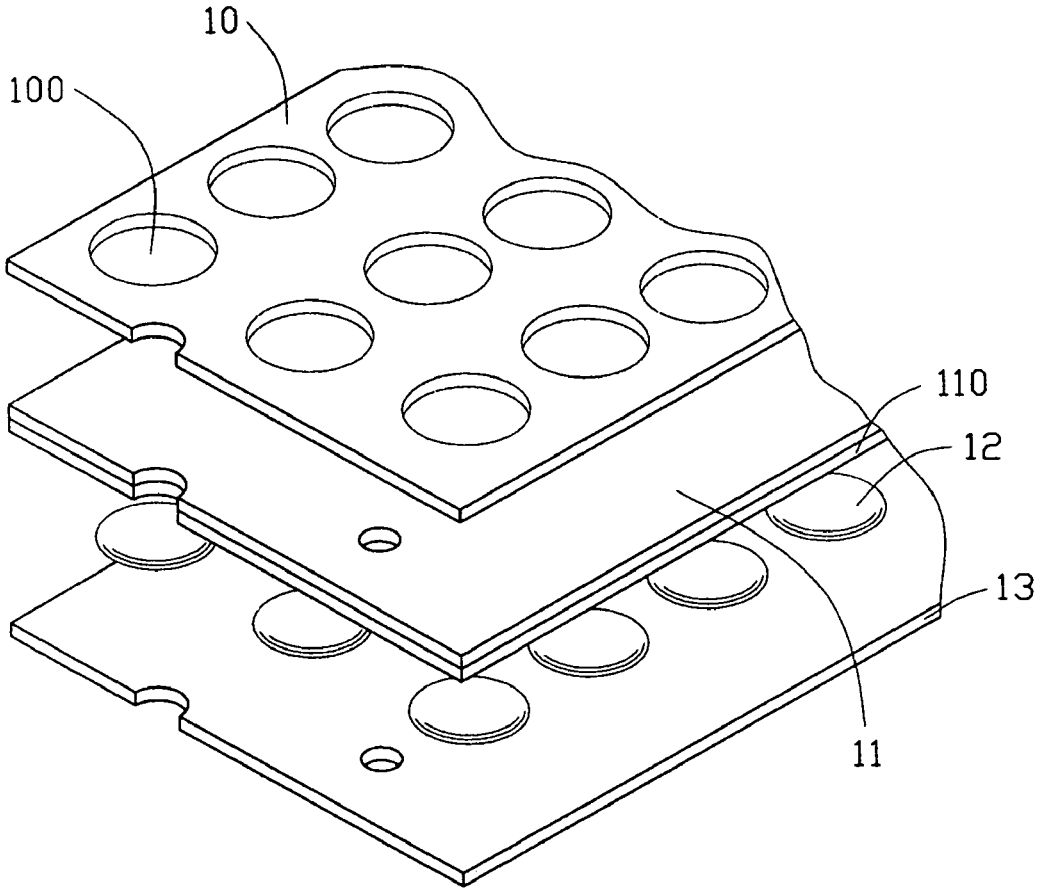
FIG. 1 is an exploded perspective view of a movable contact body according to this invention.
Figure 2:
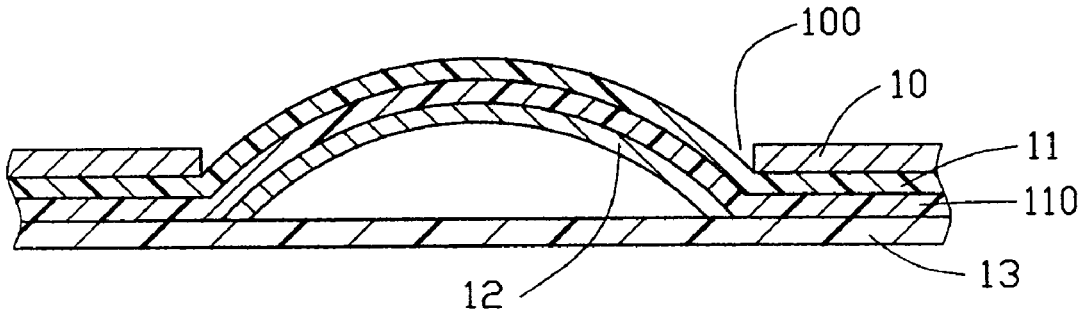
FIG. 2 is a sectional view of the movable contact body.

Referring to FIG. 1, a movable contact body in according with a preferred embodiment of the present invention comprises a separator 13, a plurality of domes 12, an insulative film 11 and a shielding 10.

The separator 13 is a substantially substrate sheet. The separator 13 may be made of paper or other insulative material to prevent the corrosion of the domes 12 by the gases in air or the sticking of foreign matter thereto. The domes 12 are made of conductive and resilient material. The domes 12 are disposed on the separator 13 in predetermined locations and are secured on the separator 13 by upper surfacely coated by the insulative film 11. The insulative film 11 is made of insulative and resilient material. The insulative film 11 is adhesive to the separator 13 and upper surfaces of the domes 12 by employing an adhesive agent 110 on its lower surface and secures the domes 12 therebetween.

The shielding 10 is a planar and conductive sheet and has a plurality of openings 100 corresponding to domes 12 defined thereon in predetermined locations. The shielding 10 coats on the insulative film 11. The openings 100 are larger than the domes 12 in diameter. Each opening 100 receives a corresponding dome 12 therein. The shielding 10 is the left material of the domes after punching in fact.

Figure 3:
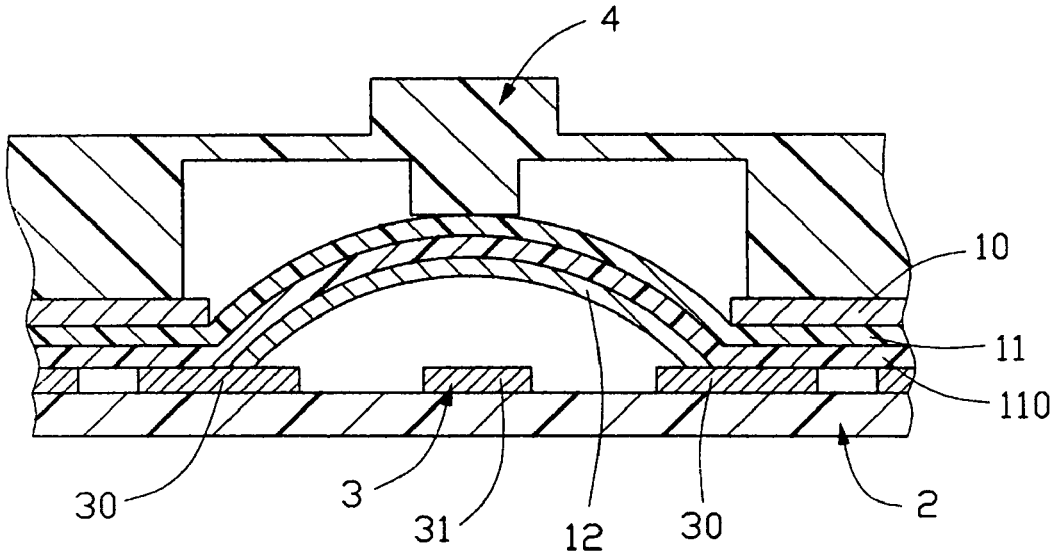
FIG. 3 is a sectional view showing a panel switch employing the movable contact body.

Referring to FIG. 3, the movable contact body applied in a panel switch is shown. In application, the separator 13 is removed. The movable contact body is mounted on an insulative sheet 2 of the panel switch. The insulative sheet 2 has a plurality of fixed contacts 3 provided thereon corresponding to the domes 12. Each fixed contact 3 comprises a central fixed contact 31 and a periphery fixed contact 30 surrounding the central fixed contact 31, which are electrically separated from each other. The domes 12 are disposed corresponding to the fixed contacts 3. Apexes of the domes 12 are disposed corresponding to the central fixed contacts 31 and over there, periphery portions of the domes 12 are disposed on and contact with the periphery fixed contacts 30. An actuator panel is mounted on the shielding 10. The actuator panel has a plurality of actuators 4 for depressing the apexes of corresponding domes 12.

In operation, an external force is exerted on one of the actuator 4, the corresponding dome 12 is caused to contact with central fixed contact 31, and an electrical connection between the central fixed contact 31 and the periphery fixed contact 30 is established. When the external force is removed, the dome 12 recovers to a normal status, and the electrical connection is eliminated.

As is described in the foregoing, the shielding 10 is a byproduct of the domes 12. In processing, the domes 12 are punched from a planar metal sheet and the left material is used as the shielding 10 then, which can save much material.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

We claim:

1. A movable contact body for a panel switch comprising:

a separator made of insulative material;

a plurality of domes made of resilient conductive material, and located on the separator;

an insulative film coating on each of the domes; and a planar shielding made of conductive material and covering on the insulative film, the shielding having a plurality of openings in predetermined locations corresponding to the domes, each opening receiving one dome therein.

2. The movable contact body for a panel switch as claimed in claim 1, the domes are punched from a metal sheet and the shielding is formed by the remaining material of the metal sheet after punching the domes.

3. The movable contact body for a panel switch as claimed in claim 1, the insulative film is adhesive to the separator and secures the domes thereunder.

4. The movable contact body for a panel switch as claimed in claim 1, the insulative film coats on upper surfaces of the domes and has an adhesive agent on its lower surface.

5. A panel switch comprising:

an insulative sheet;

a plurality of central fixed contacts disposed on the insulative sheet in predetermined locations;

a plurality of peripheral fixed contacts adjacent to the central fixed contacts;

a plurality of domes made of resilient conductive material and disposed corresponding to the fixed contacts, each dome comprising an apex disposed above a corresponding central fixed contact and a peripheral portion disposed on and contacting with a corresponding peripheral fixed contact;

an insulative film coating on each of the domes;

a planar shielding made of conductive material and on the insulative film, the shielding having a plurality of openings exposing corresponding domes, each opening receiving one dome therein; and an actuator panel having a plurality of actuators for depressing the apexes of corresponding domes to contact with the central fixed contacts.

6. The panel switch as claimed in claim 5, the domes are punched from a metal sheet and the shielding is formed by the remaining material of the metal sheet after punching the domes.

7. The panel switch as claimed in claim 5, the insulative film is adhesive to the separator and secures the domes thereunder.

8. The panel switch as claimed in claim 5, the insulative film coats on upper surfaces of the domes and has an adhesive agent on its lower surface.

9. A panel switch comprising:

an insulative sheet;

a plurality of first fixed contacts disposed on the insulative sheet;

a plurality of second fixed contacts disposed on the insulative sheet adjacent to the corresponding first fixed contacts, respectively;

a plurality of domes made of resilient conductive material and disposed around corresponding fixed contacts so as to electrically connect the corresponding first fixed contacts and second first contacts, respectively;

an insulative film coating on each of the domes;

a planar shielding made of conductive material and displaceable on the insulative film, the shielding having a plurality of openings exposing corresponding domes, each opening receiving at least one dome therein; and an actuator panel made of insulative compressible material and having a plurality of actuators for downwardly depressing the corresponding domes.

* * * * *